US010088212B2

(12) United States Patent
Miller et al.

(10) Patent No.: US 10,088,212 B2
(45) Date of Patent: Oct. 2, 2018

(54) REFRIGERATOR APPLIANCE AND DISPENSER

(71) Applicant: Haier US Appliance Solutions, Inc., Wilmington, DE (US)

(72) Inventors: Charles Benjamin Miller, Louisville, KY (US); Andrew Reinhard Krause, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 95 days.

(21) Appl. No.: 15/208,664

(22) Filed: Jul. 13, 2016

(65) Prior Publication Data

US 2018/0017309 A1 Jan. 18, 2018

(51) Int. Cl.

| | |
|---|---|
| ***F25C 5/18*** | (2018.01) |
| ***F25C 1/04*** | (2018.01) |
| ***F25C 5/20*** | (2018.01) |
| ***F25C 5/182*** | (2018.01) |

(52) U.S. Cl.

CPC ..... *F25C 5/22* (2018.01); *F25C 1/04* (2013.01); *F25C 5/182* (2013.01)

(58) Field of Classification Search

CPC .. F25C 1/04; F25C 5/182; F25C 5/005; F25C 5/22

USPC ..... 141/337, 331, 332

See application file for complete search history.

(56) References Cited

U.S. PATENT DOCUMENTS

| | | | | | |
|---|---|---|---|---|---|
| 726,685 | A * | 4/1903 | Holbrook | B66C 19/002 | 193/30 |
| 1,946,760 | A * | 2/1934 | Rhine | B65G 11/186 | 193/2 R |
| 3,428,156 | A * | 2/1969 | Charyn | B65G 11/083 | 138/120 |
| 3,640,088 | A * | 2/1972 | Jacobus | F25C 1/24 | 62/320 |
| 3,926,290 | A * | 12/1975 | Isojima | B63B 27/28 | 193/27 |
| 4,102,660 | A * | 7/1978 | Beckett | F25C 5/22 | 62/344 |
| 4,153,183 | A * | 5/1979 | Chatman | A47F 1/08 | 141/337 |
| 5,104,007 | A * | 4/1992 | Utter | F25C 5/20 | 222/146.6 |
| 5,148,842 | A * | 9/1992 | Boust | B67C 11/02 | 141/333 |
| 5,188,157 | A * | 2/1993 | Lee | B67C 11/02 | 141/330 |

(Continued)

*Primary Examiner* — Jason K Niesz
*Assistant Examiner* — James Hakomaki
(74) *Attorney, Agent, or Firm* — Dority & Manning, P.A.

(57) ABSTRACT

A refrigerator appliance and method of operation are provided. The refrigerator appliance may include a cabinet, an ice maker, a door, and a dispenser conduit. The cabinet may define a storage compartment. The ice maker may be disposed within the storage compartment. The door may be attached to the cabinet and define a dispenser recess in selective communication with the ice maker. The dispenser conduit may be disposed on the door within the dispenser recess. The dispenser conduit may include a stationary inner funnel and a slidable outer funnel extending along a passage axis. The slidable outer funnel may be disposed over an external surface of the stationary inner funnel to selectively define an extended portion of an ice passage.

18 Claims, 10 Drawing Sheets

(56) References Cited

U.S. PATENT DOCUMENTS

| | | | | |
|---|---|---|---|---|
| 5,871,037 | A * | 2/1999 | Feldt | B65B 39/02 141/314 |
| 6,267,272 | B1 * | 7/2001 | Shin | F25C 5/22 222/505 |
| 6,648,187 | B1 * | 11/2003 | Shypkowski | B67D 1/0042 222/527 |
| 7,007,500 | B2 * | 3/2006 | Lee | F25C 5/005 222/146.6 |
| 7,036,647 | B2 * | 5/2006 | Malmberg | B65G 11/146 193/25 C |
| 7,316,121 | B2 * | 1/2008 | Lee | F25D 23/025 62/344 |
| 7,874,460 | B2 * | 1/2011 | Jang | F25C 1/24 222/146.6 |
| 8,333,223 | B2 | 12/2012 | Seo | |
| 8,640,483 | B2 | 2/2014 | Chase et al. | |
| 9,797,644 | B1 * | 10/2017 | Lowe | F25C 5/002 |
| 2004/0187516 | A1 * | 9/2004 | Lee | F25C 5/22 62/389 |
| 2008/0047631 | A1 * | 2/2008 | Baker | B67C 11/02 141/332 |
| 2010/0313595 | A1 | 12/2010 | Seo | |
| 2015/0276293 | A1 * | 10/2015 | Seo | F25C 5/22 222/1 |
| 2017/0191725 | A1 * | 7/2017 | Allam | F25C 5/20 |

* cited by examiner

REFRIGERATOR APPLIANCE AND DISPENSER

FIELD OF THE INVENTION

The present subject matter relates generally to refrigerator appliances and ice dispensers for refrigerator appliances.

BACKGROUND OF THE INVENTION

Certain refrigerator appliances include an ice maker. In order to produce ice, liquid water is directed to the ice maker and frozen. A variety of ice types can be produced depending upon the particular ice maker used. For example, certain ice makers include a mold body for receiving liquid water. An auger or ejector within the mold body can rotate and scrape ice off an internal surface of the mold body to form ice nuggets or cubes. Once ice is scraped off the mold body, it may be dispensed or directed outside of the refrigerator appliance. A user command may cause the refrigerator appliance to automatically dispense a selected or desired amount of ice.

Dispensing ice may pose certain challenges, though. For example, ice is generally stored within a bucket, and a guide channels the ice from the bucket to a container within a dispenser recess of an associated refrigerator appliance. Gravity generally urges the ice through the guide. In turn, the ice may be collected in a separate cup or container below the guide. However, ice may swirl within the guide as it is being dispensed, thereby gaining a non-vertical velocity component. As the ice exits the funnel at the dispenser recess, ice can thus "spray" in an undesirable pattern and miss the cup or container below the guide. In some instances, ice may ricochet or bounce outside of the cup or container. Some refrigerator appliances experience further difficulties channeling ice out of the dispenser. For example, ice may tend to accumulate or clump within the dispenser. Melting and/or friction bind multiple pieces of ice together, restricting the effective size or shape of the guide through which ice must pass. Thus, ice may block passage through the guide before it is able to reach the cup or container.

Accordingly, a refrigerator appliance with features for reducing the spray of ice at a dispenser of the refrigerator appliance would be useful. It would be advantageous if a refrigerator appliance additionally or alternatively included features for reducing the likelihood that ice would be blocked through the dispenser.

BRIEF DESCRIPTION OF THE INVENTION

Aspects and advantages of the invention will be set forth in part in the following description, or may be obvious from the description, or may be learned through practice of the invention.

In one aspect of the present disclosure a refrigerator appliance is provided. The refrigerator appliance may include a cabinet, an ice maker, a door, and a dispenser conduit. The cabinet may define a storage compartment. The ice maker may be disposed within the storage compartment. The door may be attached to the cabinet to selectively restrict access to the storage compartment. The door may also define a dispenser recess in selective communication with the ice maker. The dispenser conduit may be disposed on the door within the dispenser recess. The dispenser conduit may include a stationary inner funnel and a slidable outer funnel extending along a passage axis. The stationary inner funnel may have an internal surface and an opposing external surface, wherein the internal surface faces the passage axis and defines at least a portion of an ice passage while the external surface faces away from the passage axis. The slidable outer funnel may be disposed over the external surface of the stationary inner funnel to selectively define an extended portion of the ice passage.

In another aspect of the present disclosure, a method of operating a refrigerator appliance is provided. The refrigerator appliance may include a cabinet, a door attached to the cabinet, and a dispenser conduit disposed on the door. The dispenser conduit may include a stationary inner funnel and a slidable outer funnel extending along a passage axis to define an ice passage length. The method may include determining a desired ice passage length, and moving the slidable outer funnel along the passage axis across an external surface of the stationary inner funnel based on the desired ice passage length.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
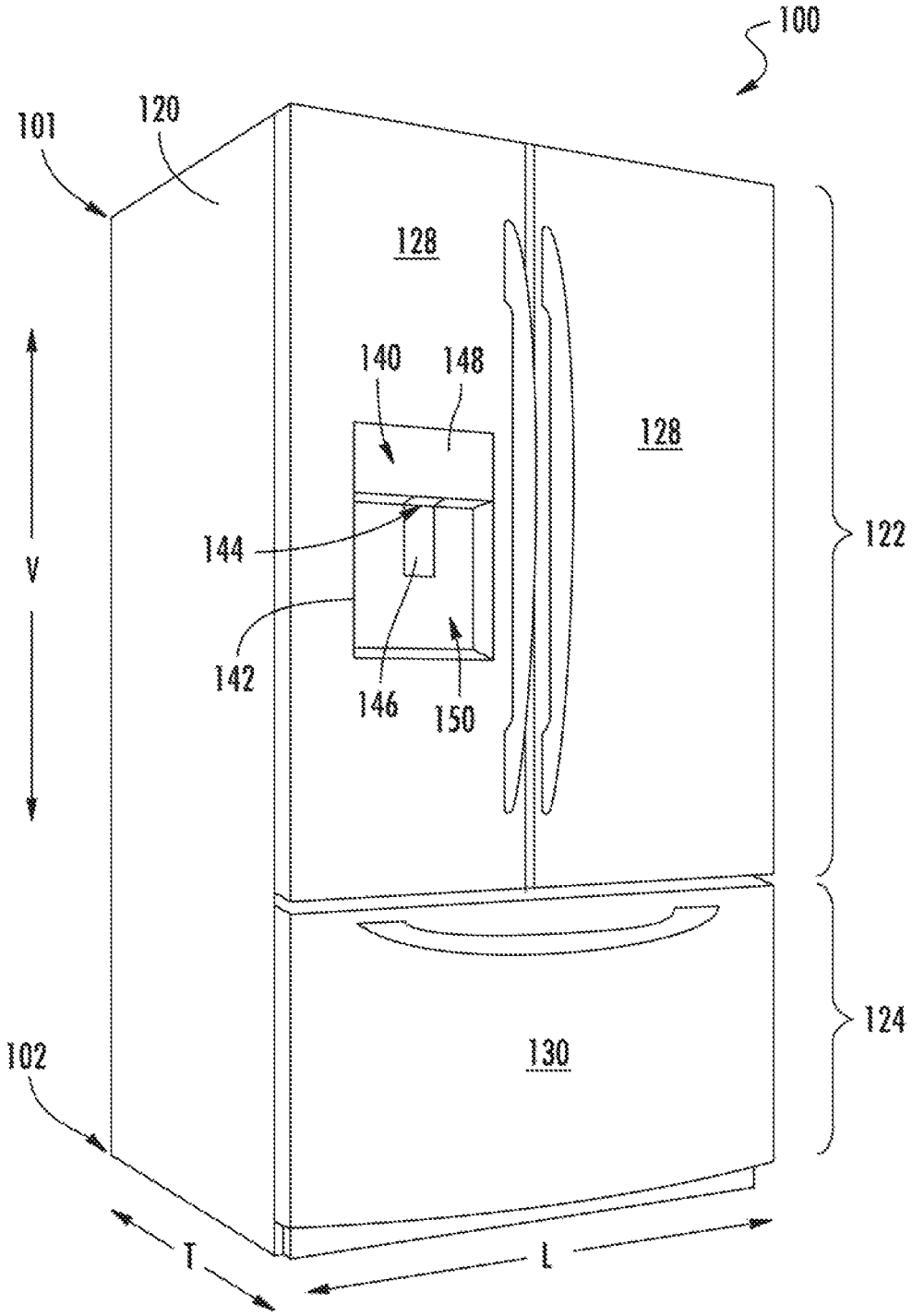
FIG. 1 provides a perspective view of a refrigerator appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, exemplary embodiments of the present disclosure may include a refrigerator that includes an extendable dispenser conduit. The dispenser conduit may include multiple funnels, such as an inner funnel and one or more outer funnels that define an ice passage. An outer funnel may slide up and down along the inner funnel, telescoping between an extended and a contracted position. The outer funnel may further have a rear opening, advantageously increasing the area through which ice may pass.

FIG. 1 provides a perspective view of a refrigerator appliance 100 according to an exemplary embodiment of the present disclosure. Refrigerator appliance 100 includes a cabinet or housing 120 that defines a vertical direction V, a lateral direction L, and a transverse direction T. The vertical direction V, lateral direction L, and transverse direction are all mutually perpendicular and form an orthogonal direction system. Housing 120 extends between a top 101 and a bottom 102 along a vertical direction V. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs 149, such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150, defined at least partially by a dispenser back wall 152. Dispenser recess 150 is defined at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

A dispenser conduit 200 generally corresponds to discharging outlet 144. Conduit 200 serves to guide ice into dispenser recess 150. As discussed in greater detail below, discharging outlet 144 may be selectively moved manually or automatically according to, for example, the height of a presented container 216 (see FIG. 4) within dispenser recess 150. In some embodiments, a variable actuator 218 (see FIG. 4) is operably attached to a portion of dispensing assembly 140 and selectively motivates the discharging outlet 144 to raise or lower according to one or more input.

Figure 2:
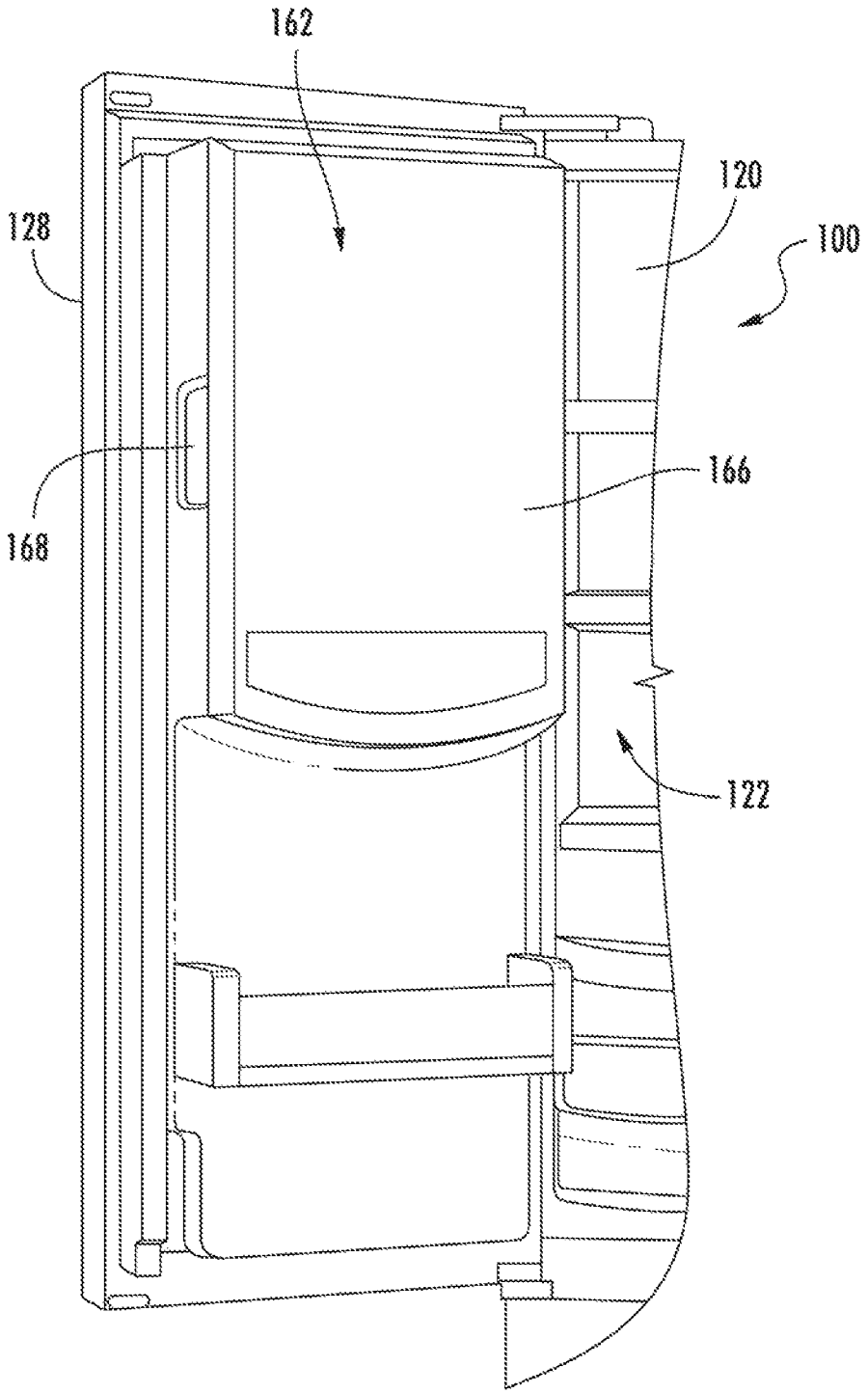
FIG. 2 provides a perspective view of a refrigerator door of the exemplary refrigerator appliance embodiment of FIG. 1.

FIG. 2 provides a perspective view of a door of refrigerator doors 128. Refrigerator appliance 100 includes a sub-compartment 162 defined on refrigerator door 128. Sub-compartment 162 is often referred to as an "icebox." Sub-compartment 162 extends into fresh food chamber 122 when refrigerator door 128 is in the closed position. Additionally or alternatively, icebox compartment 162 may be defined within door 130 and extend into freezer chamber 124.

As discussed in greater detail below, an ice maker or ice making assembly 160 and an ice storage bin 164 (FIG. 3) are positioned or disposed within sub-compartment 162. Thus, ice is supplied to dispenser recess 150 (FIG. 1) from the ice making assembly 160 and/or ice storage bin 164 in sub-compartment 162 on a back side of refrigerator door 128. Chilled air from a sealed system (not shown) of refrigerator appliance 100 may be directed into sub-compartment 162 in order to cool ice making assembly 160 and/or ice storage bin 164. In alternative exemplary embodiments, a temperature of air within sub-compartment 162 may correspond to a temperature of air within fresh food chamber 122, such that ice within ice storage bin 164 melts over time.

An access door 166 is hinged to refrigerator door 128. Access door 166 permits selective access to freezer sub-compartment 162. Any manner of suitable latch 168 is included with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162, e.g., by thermally isolating or insulating freezer sub-compartment 162 from fresh food chamber 122.

Figure 3:
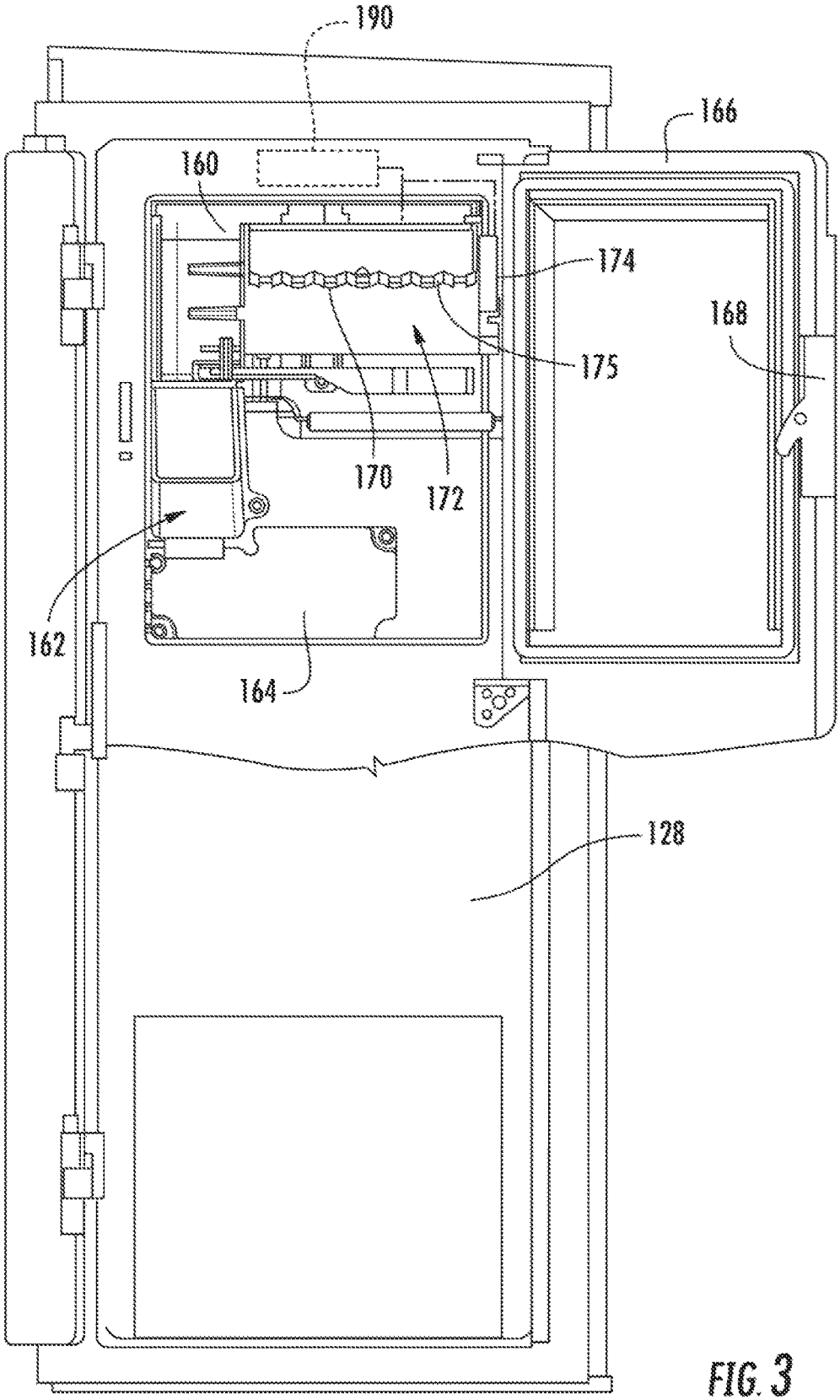
FIG. 3 provides an elevation view of the door of the exemplary refrigerator appliance embodiment of FIG. 2, with an access door of the refrigerator door shown in an open position.

FIG. 3 provides an elevation view of refrigerator door 128 with access door 166 shown in an open position. As may be seen in FIG. 3, ice making assembly 160 is positioned or disposed within freezer sub-compartment 162. In some embodiments, ice making assembly 160 includes a mold body or casing 170 for the receipt of water for freezing. In particular, mold body 170 may receive liquid water and such liquid can freeze therein and form ice cubes. Optionally, an ice ejector 172 may be provided to direct ice cubes to dispensing assembly 140. As shown, ejector 172 includes an ejector motor 174 operably attached to one or more ejector arms 175. When activated, ejector motor 174 motivates, e.g., rotates, ejector arm 175 within ice making assembly 160 to remove ice cubes once formed within mold body 170. Ice bucket or ice storage bin 164 is positioned below ejector 172 and receives the ice from ice mold 172. From ice storage bin 164, the ice can enter dispensing assembly 140 and be accessed by a user as discussed above. In such a manner, ice making assembly 160 can produce or generate ice.

Figure 4:
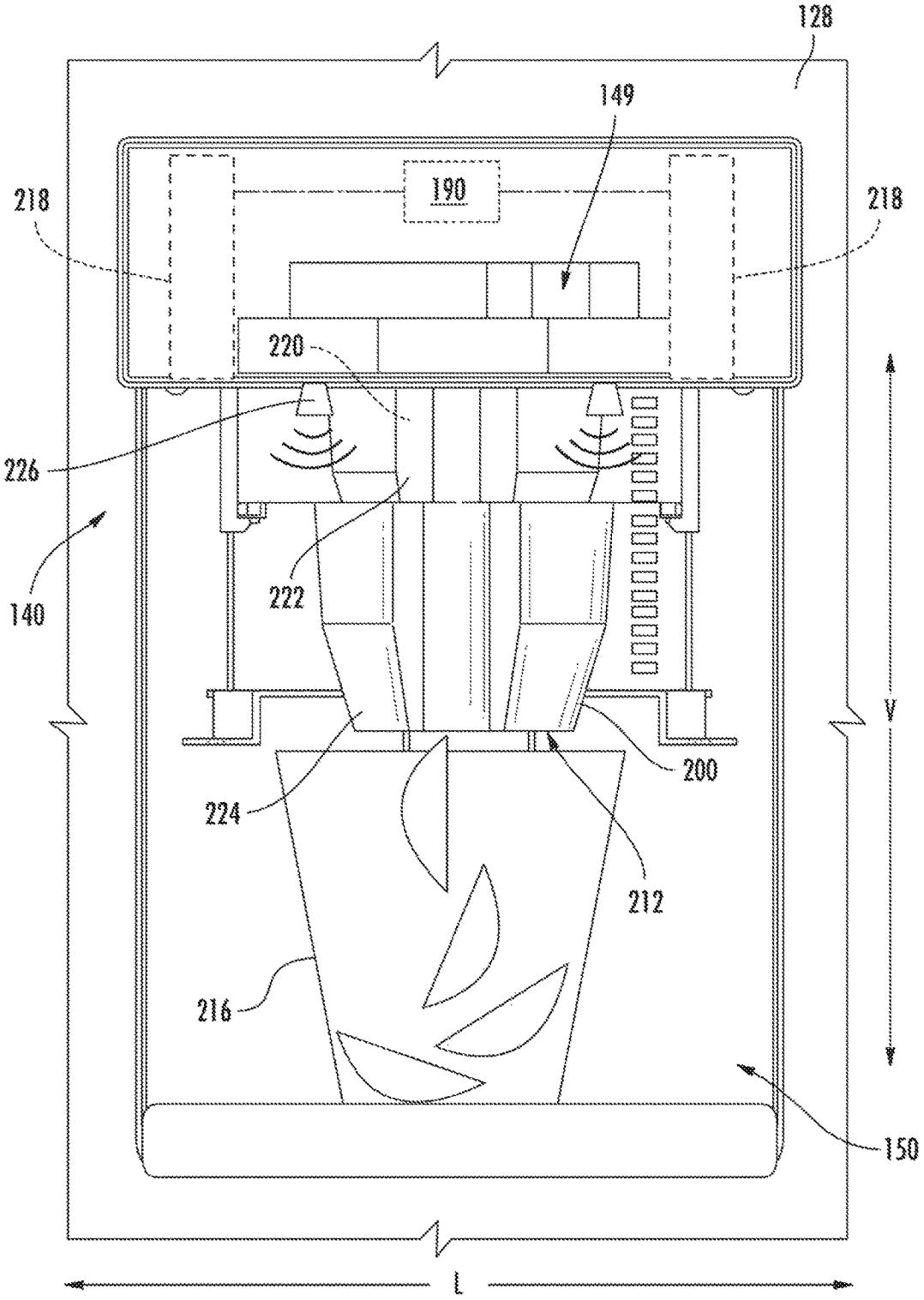
FIG. 4 provides a front view of a portion of a dispensing assembly of the exemplary refrigerator appliance embodiment of FIG. 1, with a dispenser conduit shown in an extended position.

FIG. 4 provides a front view of dispensing assembly 140, including a dispenser conduit 200 for guiding ice from ice making assembly 160. As shown, dispenser conduit 200 may be positioned at least partially within refrigerator door 128 and extend into dispenser recess 150. Dispenser conduit 200 generally includes a stationary inner funnel 220 (see FIG. 6) and a slidable outer funnel 222 positioned over a portion of stationary inner funnel 220. One or more additional outer funnels, e.g., secondary outer funnel 224, may be included in certain embodiments. In optional embodiments, one or more variable actuators 218 are attached to outer funnels 222, 224. A variable actuator 218 may, for example, be a suitable motivating member or motor, such as an electric or hydroelectric linear actuator. Additionally or alternatively, one or more proximity sensors 226 are provided to detect or measure an object, such as a presented container 216 for receiving ice. As will be described below, variable actuators 218 may slide or motivate outer funnel(s) 222, 224 relative to stationary inner funnel 220 (see FIG. 6), e.g., in a telescoping motion, according to a desired length of dispenser conduit 200.

As shown in FIGS. 3 and 4, exemplary embodiments may include a processing device or controller 190 in operative communication with one or more portion of ice making assembly 160 and/or dispensing assembly 140. In some such embodiments, operation of ice making assembly 160 and/or dispensing assembly 140 is controlled by controller 190. For example, controller 190 may be operably coupled to control panel 148 for user or automatic selection of certain features and operations of ice making assembly 160 and/or dispensing assembly 140.

Controller 190 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. For certain embodiments, the instructions include a software package configured to operate appliance 100 and, e.g., execute the exemplary method 300 described below with reference to FIG. 11. The memory can be a separate component from the processor or can be included onboard within the processor. Alternatively, controller 194 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In optional embodiments, such as embodiments illustrated in FIG. 3, controller 190 operates various components of ice making assembly 160 to execute selected system cycles and features. For example, controller 190 is operably coupled to motor 174. Under certain conditions, controller 190 can selectively activate and operate one or more of the motor 174.

In exemplary embodiments, ice making assembly 160 also includes a temperature sensor 178. Temperature sensor 178 measures a temperature of casing 170 and/or liquids, such as liquid water, within casing 170. Temperature sensor 178 can be any suitable device for measuring the temperature of casing 170 and/or liquids therein. For example, temperature sensor 178 may be a thermistor or a thermocouple. Controller 190 can receive a signal, such as a voltage or a current, from temperature sensor 190 that corresponds to the temperature of the temperature of casing 170 and/or liquids therein. In such a manner, the temperature of casing 170 and/or liquids therein can be monitored and/or recorded with controller 190.

In additional or alternative embodiments, such as embodiments illustrated in FIG. 4, controller 190 operates various components of dispensing assembly 140 to execute selected system cycles and features. For example, controller 190 is in operably coupled to variable actuators 218 and/or proximity sensors 226. Under certain conditions, controller 190 can selectively activate and operate variable actuator(s) 218 to raise (e.g., contract) or lower (e.g., expand) a portion of dispenser conduit 200 along the vertical direction V, as will be described below. In certain embodiments, the activation or operation of variable actuators 218 is at least partially based on a detection signal received from proximity sensor 226. In additional or alternative embodiments, the activation or operation of variable actuators 218 is at least partially based on user inputs received from, e.g., user input panel 148.

As illustrated in FIG. 4, certain exemplary embodiments of dispensing assembly 140 include one or more proximity sensors 226. In some such embodiments, a proximity sensor 226 is fixed on refrigerator door 128, e.g., within dispenser recess 150. Proximity sensor 226 may be operable to detect the presence of an object, e.g., a presented container 216. Optionally, proximity sensor 226 may be operable to measure the height of presented container 216, e.g., the distance between proximity sensor 226 and presented container 216. In exemplary embodiments, proximity sensor 226 can be any suitable device for detecting or measuring distance to an object. For example, proximity sensor 226 may be an ultrasonic sensor, an infrared sensor, or a laser range sensor. Controller 190 can receive a signal, such as a voltage or a current, from proximity sensor 226 that corresponds to the detected presence of or distance to a presented container 216. According to the signal(s) from proximity sensor 226, the controller 190 may transmit one or more signals, e.g., to variable actuator(s), corresponding to the desired position of variable actuator(s) 218 and/or dispenser conduit 200.

Figure 5:
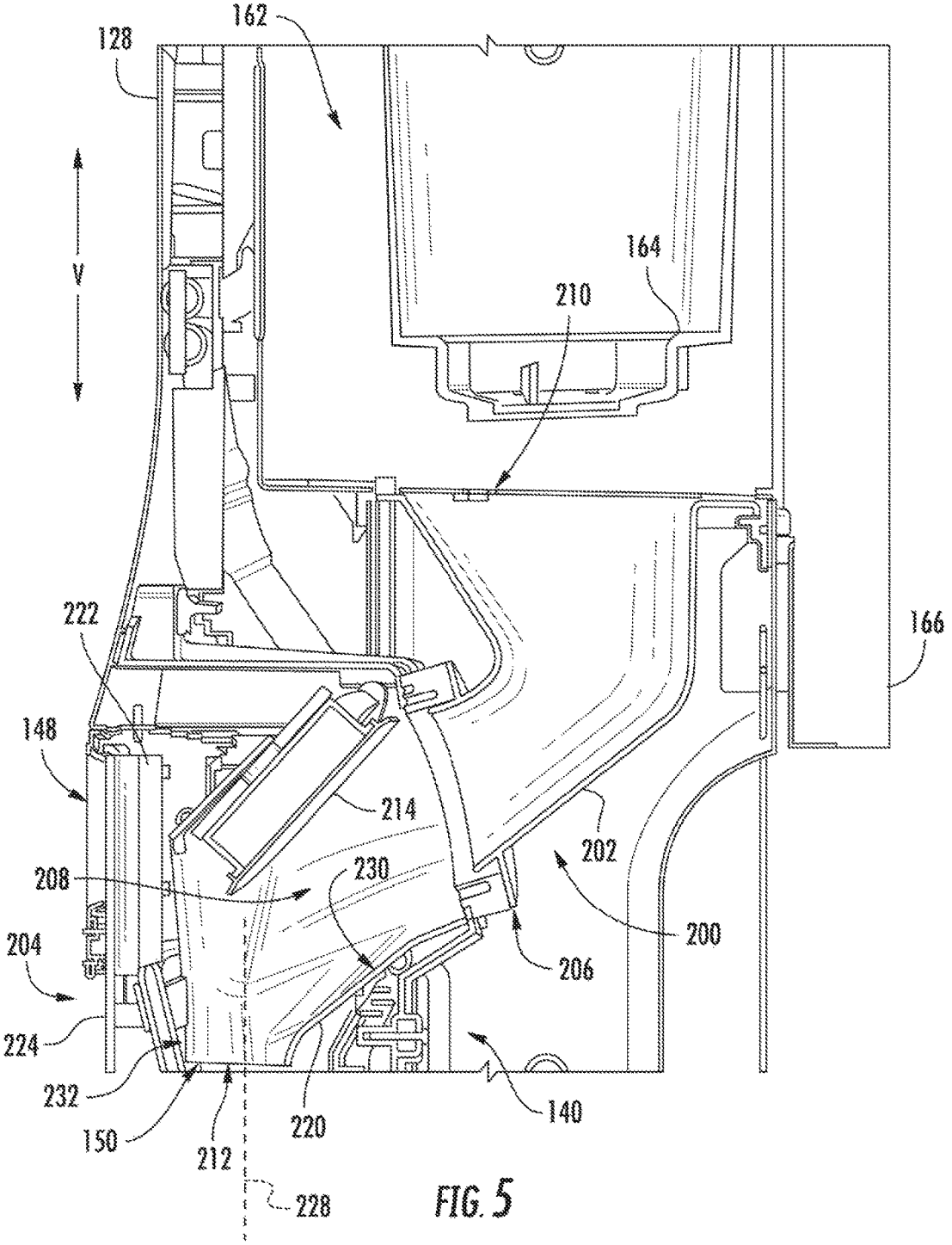
FIG. 5 provides a cross sectional view of the exemplary dispensing assembly of FIG. 4, with the dispenser conduit shown in a contracted position.
Figure 6:
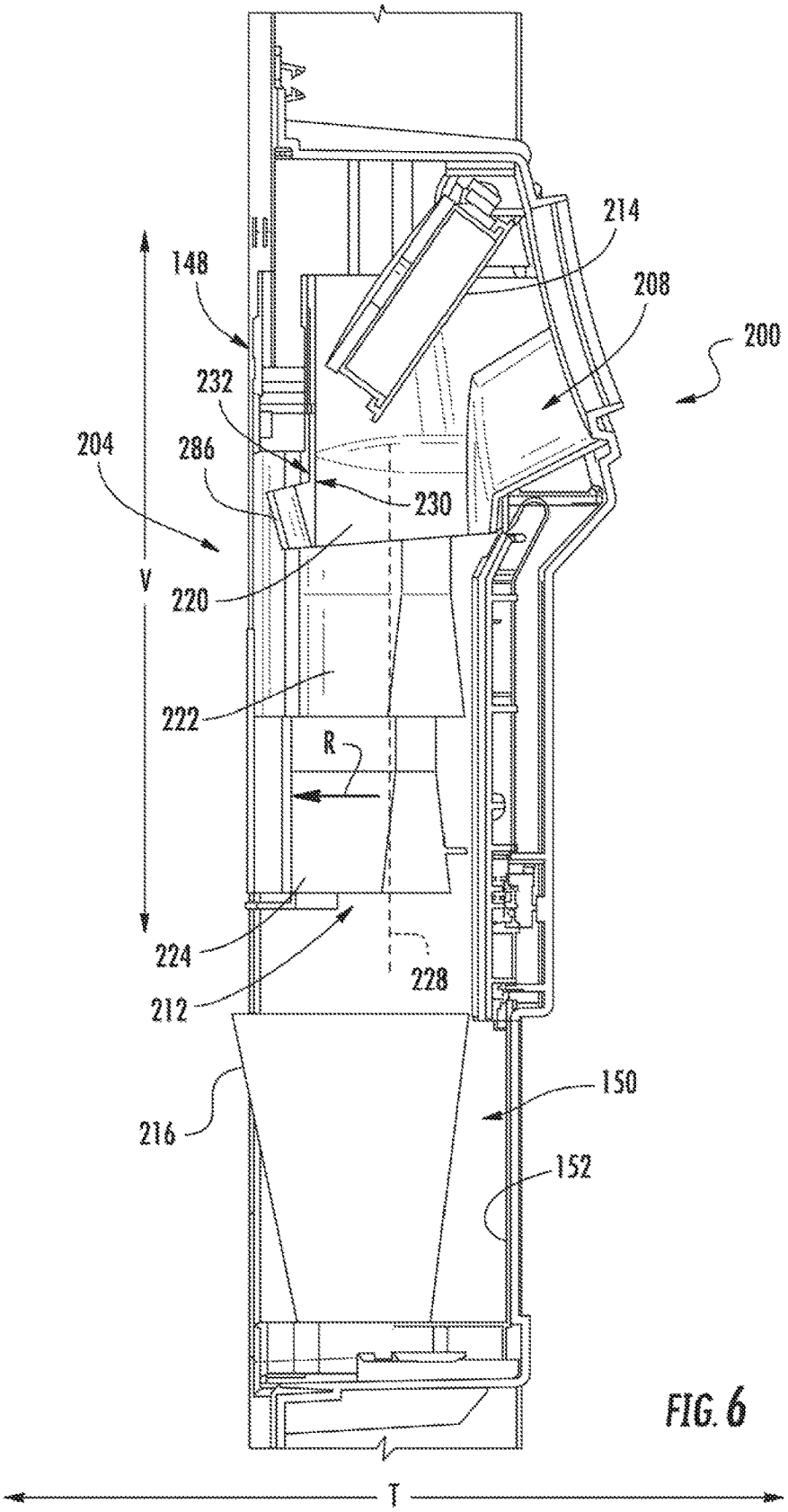
FIG. 6 provides a cross sectional view of a portion of the exemplary dispensing assembly of FIG. 4, with the dispenser conduit shown in an extended position.
Figure 7:
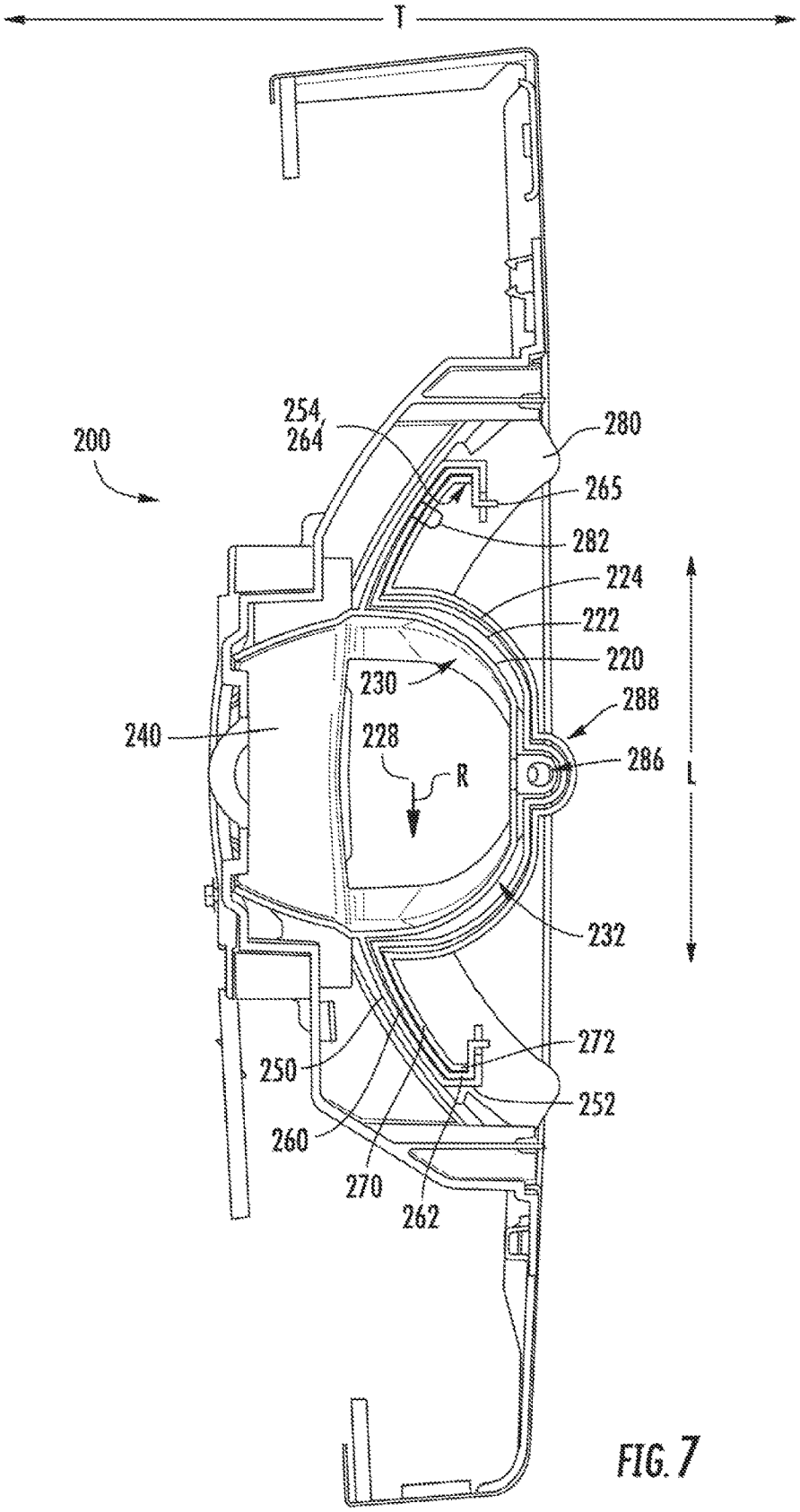
FIG. 7 provides a top, plan view of a portion of the exemplary dispensing assembly of FIG. 4, including a dispenser conduit.
Figure 8:
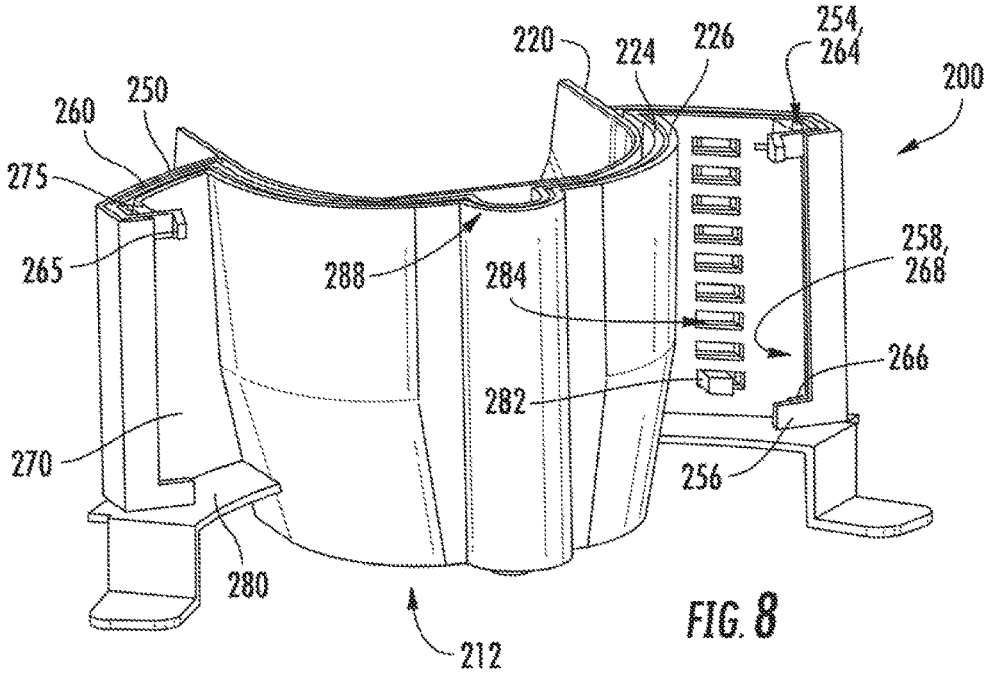
FIG. 8 provides a front, perspective view of the exemplary dispenser conduit embodiment of FIG. 7, with the dispenser conduit shown in a contracted position.
Figure 9:
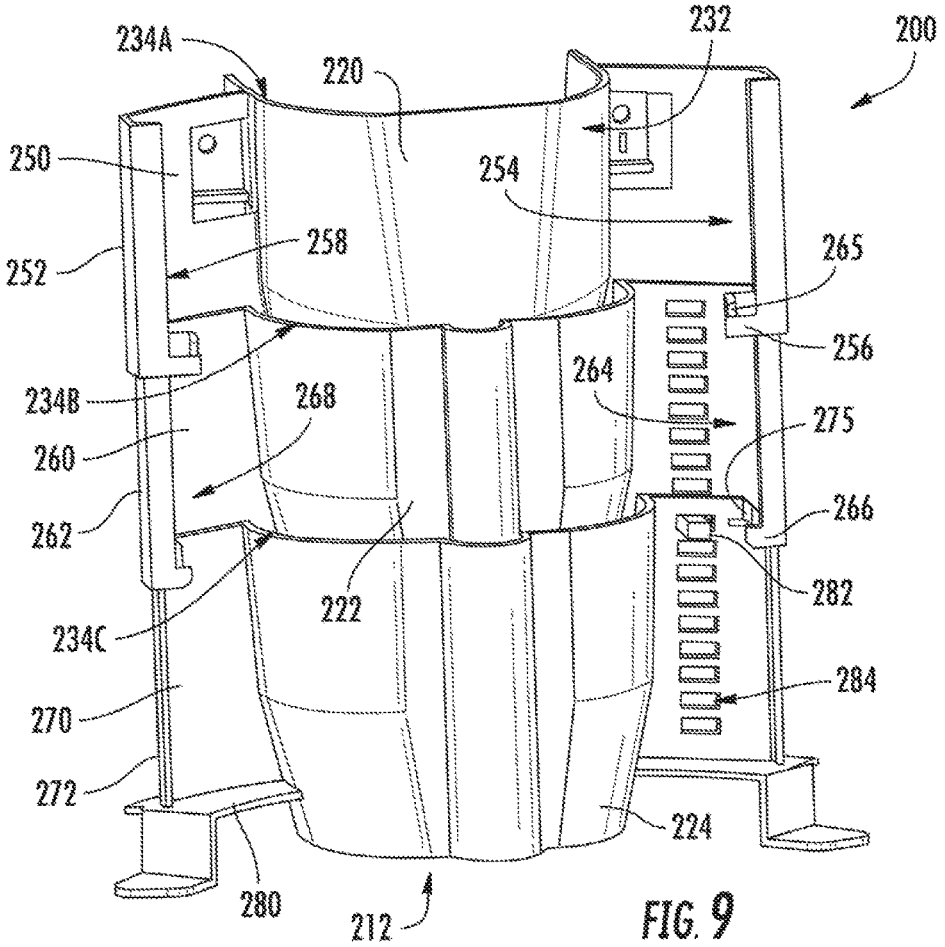
FIG. 9 provides a front, perspective view of the exemplary dispenser conduit embodiment of FIG. 7, with the dispenser conduit shown in an extended position.
Figure 10:
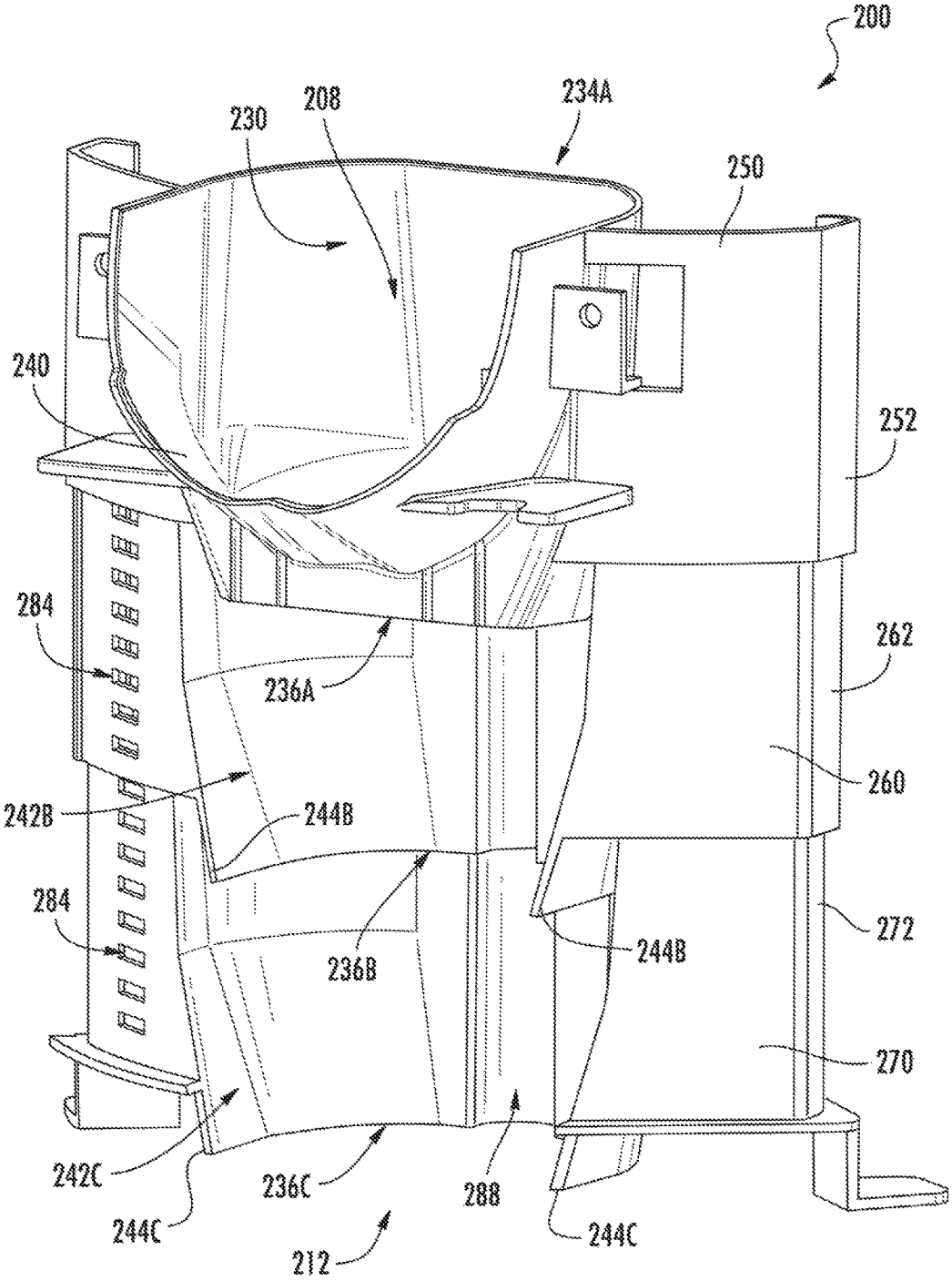
FIG. 10 provides a rear, perspective view of the exemplary dispenser conduit embodiment of FIG. 7, with the dispenser conduit shown in an extended position.

FIGS. 5 and 6 provide cross sectional views of dispensing assembly 140 of refrigerator appliance 100. As noted above, dispensing assembly 140 includes a dispenser conduit 200 positioned at least partially within one of refrigerator doors 128. Dispenser conduit 200 may extend from ice making assembly 160, e.g., at ice storage bin 164 to dispenser recess 150. In exemplary embodiments, dispenser conduit 200 includes a top piece or member 202 that is joined or connected bottom piece or member 204 at joint 206. As shown, dispenser conduit 200 defines variable ice passage 208 from top member 202 to bottom member 204. An inlet 210 is positioned at or adjacent ice making assembly 160, while a variable outlet 212 is positioned below inlet 210 in the vertical direction V. It is understood that outlet 212 substantially forms or corresponds to discharging outlet 144 (FIG. 1).

Dispensing assembly 140 may move between a contracted position (FIG. 5), wherein outlet 212 is substantially raised (e.g., at a vertical maximum relative to back wall 152), and an extended position (FIG. 6), wherein outlet 212 is substantially lowered (e.g., at a vertical minimum relative to back wall 152, or otherwise below contracted position). In exemplary embodiments, during use of appliance 100, dispenser conduit 200 may selectively move between the raised and lowered positions, e.g., manually or automatically. In some such embodiments, bottom member 204 includes stationary inner funnel 220, as well as one or more outer funnels 222, 224 that are positioned outside of stationary inner funnel 220 to move relative to stationary inner funnel 220.

A duct door 214 is positioned within dispenser conduit 200, e.g., at or adjacent the joint 206 between top member 202 and bottom member 204 of dispenser conduit 200. Duct door 214 is selectively adjustable (e.g., rotatable) between an open position (shown in FIG. 4) and a closed position. In the closed position, duct door 214 is covers a passage between dispenser recess 150 and freezer sub-compartment 162. For example, in the closed position, duct door 214 may span across an internal portion of dispenser conduit 200, e.g., at joint 206. Thus, duct door 214 may block or hinder air flow between dispenser recess 150 and freezer sub-compartment 162 and reduce heat transfer between dispenser recess 150 and freezer sub-compartment 162. Conversely, in the open position, duct door 214 is not positioned between dispenser recess 150 and freezer sub-compartment 162. Thus, ice from ice making assembly 160 may flow through ice passage 208 to outlet 212 without impacting duct door 214. Duct door 214 may normally be in the closed position and may shift to the open position when a user operates actuating mechanism 146 (see FIG. 1). Dispenser conduit 214 may be sized and shaped, e.g., with a recess, for permitting movement or rotation of duct door 214 between the open and closed positions within dispenser conduit 214.

During dispensing operations, ice passage 208 directs ice from ice making assembly 160 to dispenser recess 150 such that gravity urges ice from ice storage bin 164 into and through one or more of funnels 220, 222, 224. Multiple discrete funnels 220, 222, 224 may extend along a passage axis 228 that is defined by a stationary member, e.g., stationary inner funnel 220. Optionally, passage axis 228 may be defined parallel to vertical direction V. One or more slidable outer funnels, such as a slidable outer funnel 222 and a secondary outer funnel 224, may be positioned to slide over stationary inner funnel 220, e.g., along passage axis 228. As outer funnels 222, 224 are slid downward relative to stationary inner funnel 220 along the passage axis 228, outlet 212 of dispensing assembly 140 follows the funnel positioned furthest from stationary inner funnel 220—e.g., furthest along a radial direction R from passage axis 228. According to the position of each of the outer funnels 222, 224, the length of ice passage 208 (e.g., the distance between inlet 210 and outlet 212) may be increased or decreased. Advantageously, the length of ice passage 208 may be varied without decreasing the cross sectional area through which ice must pass.

As shown, a portion of ice passage 208 is defined by stationary inner funnel 220. For instance, stationary inner funnel 220 has an internal surface 230 and an opposing external surface 232. The internal surface 230 faces the passage axis 228 and defines an internal limit (e.g., in the radial direction R) for a portion of ice passage 208. The external surface 232 faces away from the passage axis 228. As shown, slidable outer funnel 222 is disposed over the external surface 232 of the stationary inner funnel 220. As slidable outer funnel 222 is moved toward the extended position, e.g., FIG. 5, slidable outer funnel 222 selectively defines an extended portion of the ice passage 208. In optional embodiments, a secondary outer funnel 224 is provided. As dispenser conduit 200 is moved to the extended position, secondary outer funnel 224 may further define a secondary extended portion of the ice passage 208, as well as the location of outlet 212. As dispenser conduit 200 moves between the contracted position of FIG. 4 and the extended position of FIG. 5, the length of ice passage 208, as well as the position of outlet 212, is varied.

Turning to FIGS. 7 through 10, various view of dispenser conduit 200 are provided. As shown, in exemplary embodiments each of a stationary inner funnel 220, slidable outer funnel 222, and secondary outer funnel 224 are extend along passage axis 228 between discrete upper portions 234A, 234B, 234C and discrete lower portions 236A, 236B, 236C. Generally, each upper portion 234A, 234B, 234C of the funnels 220, 222, 224 includes a cross-sectional area (e.g., in a plane that is perpendicular to the vertical direction V) that is larger than a cross sectional area of the respective lower portion 236A, 236B, 236C. Slidable outer funnel 222 and secondary outer funnel 224 are positioned outward from at least a portion of stationary inner funnel 220. For example, the upper and lower portions 234B, 236B of slidable outer funnel 222 are positioned further from passage axis 228 in a radial direction R than the corresponding upper and lower portions 234A, 236A of stationary inner funnel 220. Furthermore, the upper and lower portions 234C, 236C of secondary outer funnel 224 are positioned further from passage axis 228 in the radial direction R than the corresponding upper and lower portions 234B, 236B of slidable outer funnel 222.

In some embodiments, stationary inner funnel 220 encloses a portion of ice passage 208. A chute 240 extends laterally at a rear portion of stationary inner funnel 220, proximate to back wall 152 of dispenser recess 150. Optionally, chute 240 extends in the transverse direction T at an angle, e.g., non-parallel, to the vertical direction V. During operations, chute 240 may guide falling ice toward the ice passage 208.

Each outer funnel 222, 224 defines a rear opening 242B, 242C extending radially outward from passage axis 228. Opposing lateral edges 244B, 244C define a width (e.g., outermost width in the lateral direction L) of each rear opening 242. As shown, slidable outer funnel 222 defines a rear opening 242B between opposing lateral edges 244B. Secondary outer funnel 224 defines a rear opening 242C between opposing lateral edges 244C. When dispenser conduit 200 is mounted to refrigerator door 128, each opening 242B, 242C generally faces back wall 152 of dispenser recess 150. Other than stationary inner funnel 220, the area between back wall 152 and each rear opening 242B, 242C is substantially unobstructed in optional embodiments. When outer funnels 222, 224 are moved into an extended position, the cross sectional area, e.g., perpendicular to the vertical direction V, of the portion of ice passage 208 that is below stationary inner funnel 220 will be greater than the cross sectional area of ice passage 208 through stationary inner funnel 220, e.g., at the bottom portion of stationary inner funnel 220. Advantageously, a larger cross sectional area for ice passage 208 may reduce the likelihood of ice accumulating or becoming clogged within ice passage 208.

In exemplary embodiments, one or more stationary guide brackets 250 extend from stationary inner funnel 220. For instance, two stationary guide brackets 250 may extend from opposite lateral ends in a generally radial direction, e.g., from passage axis 228. As shown, stationary guide bracket(s) 250 generally extend along a portion of passage axis 228. A stationary guide bracket 250 may be positioned parallel to the vertical direction V. Optionally, stationary guide bracket 250 may include a fixed track 252 extending parallel to passage axis 228. Fixed track 252 may define an open channel 254 therealong. For instance, open channel 254 may form a substantially U-shape in the vertical direction V. The open or unobstructed portion of the U-shaped open channel 254 may face external surface 232 of stationary inner funnel 220.

One or more of stationary guide brackets 250 may include a guide catch 256 extending alongside open channel 254. Optionally, guide catch 256 may be embodied by a lateral prong or tab. In some embodiments, guide catch 256 extends radially inward towards external surface 232 of stationary inner funnel 220. Guide catch 256 may be positioned at a bottom portion of stationary guide bracket 250. An open vertical slot 258 is defined above guide catch 256 and may extend from a top portion to a bottom portion of stationary guide bracket 250. For instance, vertical slot 258 may include the area directly above guide catch 256, e.g., in the vertical direction V.

As shown, one or more slidable guide bracket 260 is operably mated or matched to the stationary guide brackets 250. In some embodiments, one or more slidable guide brackets 260 are fixed to slidable outer funnel 222. As illustrated, exemplary embodiments include two slidable guide brackets 260 that extend from opposite lateral ends in a generally radial direction from passage axis 228. Each slidable guide bracket 260 may further extend along a portion of passage axis 228.

Slidable guide brackets 260 may be formed as complementary to the shape of stationary guide brackets 250. For instance, slidable guide bracket 260 may include a complementary track 262 mated to the fixed track 252 of stationary guide bracket 250. Optionally, slidable guide bracket 260 may be disposed at least partially within fixed track 252. When assembled, slidable guide bracket 260 may slide along stationary guide bracket 250. In some such embodiments, complementary track 262 may define an open channel 264 along slidable guide bracket 260. As shown, the open channel 264 of a complementary track 262 may further form a substantially U-shape in the vertical direction V. The open channel 264 of slidable guide bracket 260 may face an external surface of slidable outer funnel 222.

One or more of slidable guide brackets 260 may include slide tab 265 extending perpendicular to fixed track 252, e.g., in the transverse direction T, at a top portion of slidable guide bracket 260. Slide tab 265 may be embodied by a transverse prong or tab aligned with a complementary member, e.g., guide catch 256 of stationary guide bracket 250. In some embodiments, slide tab 265 is disposed above guide catch 256 to travel along the vertical slot 258, e.g., in the vertical direction V. In an extended position, such as that illustrated in FIG. 9, slide tab 265 of slidable guide bracket 260 engages guide catch 256. Slide tab 265 may rest above guide catch 256, restricting further downward movement of slidable outer funnel 222 in the vertical direction V.

In some embodiments, one or more of slidable guide brackets 260 may include a discrete guide catch 266. Guide catch 266 may be embodied by a lateral prong or tab. In some embodiments, guide catch 266 extends radially inward towards an external surface of slidable outer funnel 222. Guide catch 266 may be positioned at a bottom portion of slidable guide bracket 260. An open vertical slot 268 is defined above guide catch 266 and may extend from a top portion to a bottom portion of slidable guide bracket 260. For instance, vertical slot 268 may include the area directly above guide catch 266 and below slide tab 265, e.g., in the vertical direction V.

As noted above, exemplary embodiments include one or more additional outer funnels disposed over slidable outer funnel 222, e.g., secondary outer funnel 224. In some such embodiments, one or more secondary guide brackets 270 is operably mated or matched to the slidable guide brackets 260. One or more secondary guide brackets 270 may be fixed to secondary outer funnel 224. In exemplary embodiments, two secondary guide brackets 270 extend from opposite lateral ends in a generally radial direction, e.g., in a radial direction R from passage axis 228. Each secondary guide bracket 270 may further extend along a portion of passage axis 228.

Secondary guide brackets 270 may be formed to complement the shape of slidable guide brackets 260. For instance, slidable guide bracket 260 may include a secondary track 272 mated to the complementary track 262 of slidable guide bracket 260. Secondary guide bracket 270 may be disposed at least partially within complementary track 262. When assembled, secondary guide bracket 270 may slide along secondary guide bracket 270.

One or more of secondary guide brackets 270 may include a slide tab 275 extending perpendicular to secondary track 272, e.g., in the transverse direction T, at a top portion of secondary guide bracket 270. Slide tab 275 may be embodied by a transverse prong or tab aligned with a complementary member, e.g., guide catch 266 of slidable guide bracket 260. In some embodiments, slide tab 275 is disposed above guide catch 266 to travel along the vertical slot 268, e.g., in the vertical direction V. In an extended position, such as that illustrated in FIG. 9, slide tab 275 of secondary guide bracket 270 engages guide catch 266 of slidable guide bracket 260. Slide tab 275 may rest above guide catch 266, restricting further downward movement of slidable outer funnel 222 in the vertical direction V.

In optional embodiments, one or more strike pads 280 are disposed across a bottom portion of an outer funnel guide bracket 260, 270. In some embodiments, strike pad 280 is fixed to a bottom portion of secondary guide bracket 270. Optionally, two strike pads 280 may extend radially outward from secondary outer funnel 224 at opposite lateral ends. Each strike pad 280 may further define a planar surface extending outward from secondary guide bracket 270, e.g., in the transverse direction T. In a contracted position, such as that illustrated in FIG. 8, strike pad 280 engages a guide catch 256, 266, e.g., of slidable guide bracket 260 and/or stationary guide bracket 250. Strike pad 280 may rest below guide catch 256, 266, restricting further upward movement of secondary outer funnel 224 in the vertical direction V, e.g., in a contracted position. Debris or foreign objects falling from guide brackets 250, 260, 270, or thereabove, may be blocked by strike pad 280 and restricted from entering a presented container 216 (see FIG. 4) below dispenser conduit 200, e.g., in the vertical direction V.

In optional embodiments, a set of incremental stops may be provided on one or more of the guide brackets 250, 260, 270. The incremental stops may determine a position at which dispenser conduit 200 is held during use. For instance, a stop pin 282 may be provided to selectively engage one or more apertures 284. Stop pin 282 may include a resilient member that can be elastically deflected away from an aperture 284 before returning to biased engagement therewith. In some such embodiments, stop pin 282 is fixed to stationary inner funnel 220, e.g., via stationary guide bracket 250. As shown, stop pin 282 extends outward from stationary guide bracket 250, e.g., in the transverse direction T. Multiple discrete apertures 284 are defined through slidable guide bracket 260 and secondary guide bracket 270. The apertures 284 may be indexed along a direction parallel to the passage axis 228, e.g., the vertical direction V, such that each index defines a discrete vertical position for the guide brackets 260, 270 and/or funnels 222, 224.

When assembled, stop pin 282 is biased toward the slidable guide bracket 260 and secondary guide bracket 270. According to the desired position of slidable outer funnel 222 and/or secondary outer funnel 224, stop pin 282 may engage selected apertures 284 of slidable guide bracket 260 and/or secondary guide bracket 270. Each aperture 284 may correspond to a discrete ice passage length. Once slidable outer funnel 222 and/or secondary outer funnel 224 are moved to a desired length, stop pin 282 may extend through an aperture 284 of one or both of slidable guide bracket 260 and secondary guide bracket 270. Once stop pin 282 is extended through the aperture(s) 284, dispenser conduit 200 may be maintained at that length until a new length is desired.

A water conduit 286 is disposed on the dispenser conduit 200 of exemplary embodiments. Generally, water conduit 286 is disposed in selective fluid communication with a water source (not pictured), such as a municipal water supply, e.g., via one or more fluid tubes or ducts (not pictured). During operation, water conduit 286 directs water to presented container 216 within dispenser recess 150 (see FIG. 6). In some embodiments, water conduit 286 is fixed to stationary inner funnel 220, e.g., between external surface 232 and slidable outer funnel 222. As illustrated, slidable outer funnel 222 and secondary outer funnel 224 may slide across water conduit 286, e.g., in the vertical direction V, as each is moved between a contracted position and an extended position. Optionally, an arcuate conduit recess 288 may be defined on slidable outer funnel 222 and/or secondary outer funnel 224 to cover water conduit 286. When the outer funnels 222, 224 are moved to an extended position, arcuate conduit recess 288 may guide or direct water dispensed from water conduit 286, limiting undesired splashing or misdirection of water. Although water conduit 286 is illustrated as being fixed to stationary inner funnel 220, it is understood that alternative embodiments may provide water conduit 286 as fixed to an outer funnel, e.g., secondary outer funnel 224. In some such embodiments, water conduit 286 may move, e.g., in the vertical direction V, as secondary outer funnel 224 is so moved.

Figure 11:
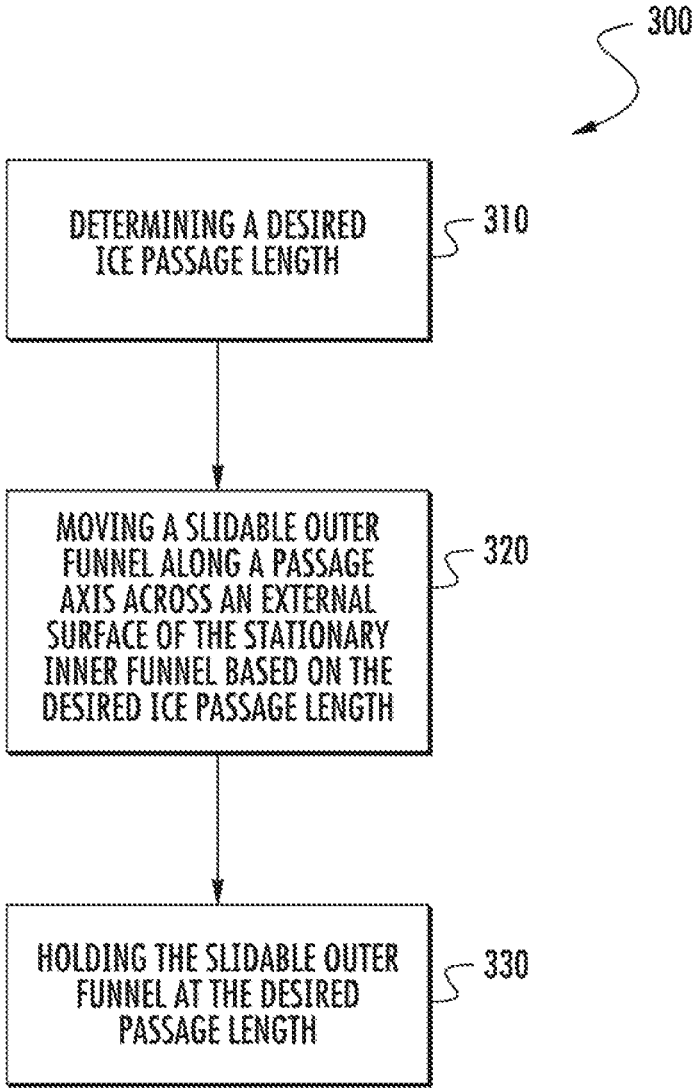
FIG. 11 provides a flow chart illustrating a method of operating a refrigerator appliance according to an exemplary embodiment of the present disclosure.

Turning now to FIG. 11, a flow diagram is provided of a method 300 according to an exemplary embodiment of the present disclosure. Generally, the method 300 provides operating a refrigerator appliance 100 (See FIG. 1) that includes a dispenser conduit 200 having a stationary inner funnel 220 and a slidable outer funnel 222 defining an ice passage 208 (see FIG. 6), as described above. The method 300 can be performed, for instance, by the controller 190. For example, controller 190 may, as discussed, be in communication with a variable actuator 218 attached to dispenser conduit 200, and may send signals to and receive signals from variable actuator 218 (see FIG. 4). Controller 190 may further be in communication with other suitable components of the appliance 100 to facilitate operation of the appliance 100, such as a user interface panel 148 and/or proximity sensor 226 (see FIG. 4). FIG. 11 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Referring to FIG. 11, at 310, the method 300 includes determining a desired ice passage length. In some embodiments, 310 includes detecting a height of a container presented below the dispenser. For instance, a distance signal may be received from a proximity sensor disposed above the container. Additionally or alternatively, a user input may be received, such as an input from a user control panel. The input may correspond to one or more predefined ice passage length settings, or the input may correspond to a general direction of movement (e.g., upward in a vertical direction or downward in a vertical direction).

At 320, the method 300 includes moving the slidable outer funnel along a passage axis across an external surface of the stationary inner funnel based on the desired ice passage length. As described above, slidable outer funnel is positioned radially outward from stationary funnel. The cross sectional area of ice passage, e.g., perpendicular to a vertical direction, may increase from the stationary inner funnel to the slidable outer funnel and/or a secondary outer funnel. In some embodiments, 320 includes articulating a variable actuator attached to the slidable outer funnel. For instance, variable actuator may be expanded or contracted parallel to a passage axis or vertical direction to expand or contract dispenser conduit. In optional embodiments, 320 may include directing a slidable guide bracket along an open channel defined by a stationary guide bracket fixed to the stationary inner funnel, as described above. In certain embodiments, 320 includes moving the slidable outer funnel across a water conduit fixed to the stationary inner funnel. Optionally, 320 may include moving a secondary outer funnel across water conduit. In other embodiments, 320 includes moving a water conduit that is fixed to the secondary outer funnel.

Optionally, one or more additional or secondary outer funnels may be provided to slide along slidable outer funnel. In some such embodiments, the method 300 includes moving a secondary outer funnel across an outer surface of the slidable outer funnel based on the desired ice passage length. The secondary outer funnel may be moved in a telescoping motion. For instance, secondary outer funnel may be extended downward in the vertical direction following full extension of slidable outer funnel. Additionally or alternatively, secondary outer funnel may be contracted upward in a vertical direction prior to moving slidable outer funnel upward toward a contracted position.

At 330, the method 300 includes holding the slidable outer funnel at the desired ice passage length. For instance, variable actuator may be halted once desired ice passage length is obtained. Additionally or alternatively, a stop pin may be extended from a stationary guide bracket and through one or more indexed apertures defined through a slidable guide bracket and/or secondary guide bracket, as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a storage compartment;

an ice maker disposed within the storage compartment;

a door attached to the cabinet to selectively restrict access to the storage compartment, the door defining a dispenser recess in selective communication with the ice maker; and a dispenser conduit disposed on the door within the dispenser recess, the dispenser conduit including a stationary inner funnel and a slidable outer funnel extending along a passage axis, the stationary inner funnel having an internal surface and an external surface; the internal surface facing the passage axis and defining at least a portion of an ice passage, the external surface facing away from the passage axis, the slidable outer funnel being disposed over the external surface of the stationary inner funnel to selectively define an extended portion of the ice passage, wherein the stationary inner funnel extends along the passage axis from an upper portion to a lower portion, wherein the slidable outer funnel extends along the passage axis from an upper portion to a lower portion, and wherein the slidable outer funnel defines a rear opening extending through the slidable outer funnel radially outward from the passage axis and along the passage axis from the lower portion of the stationary inner funnel to the lower portion of the slidable outer funnel.

2. The refrigerator appliance of claim 1, further comprising:

a secondary outer funnel disposed over the slidable outer funnel to selectively define a secondary extended portion of the ice passage.

3. The refrigerator appliance of claim 2, wherein the secondary outer funnel defines a rear opening extending through the secondary outer funnel radially outward from the passage axis, and wherein the rear opening of the slidable outer funnel and the rear opening of the secondary outer funnel are aligned as an uninterrupted cross sectional area below the lower portion of the stationary inner funnel.

4. The refrigerator appliance of claim 1, further comprising:

a stationary guide bracket fixed to the stationary inner funnel and extending radially outward therefrom; and a slidable guide bracket fixed to the slidable outer funnel and extending radially outward therefrom.

5. The refrigerator appliance of claim 4, wherein the stationary guide bracket includes a fixed track extending parallel the passage axis and defining an open channel facing the external surface of the stationary inner funnel, and wherein the slidable guide bracket includes a complementary track disposed within the open channel of the stationary guide bracket.

6. The refrigerator appliance of claim 4, wherein the slidable guide bracket defines a plurality of apertures indexed along the passage axis; and wherein the refrigerator appliance further comprises:

a stop pin attached to the stationary inner funnel and biased toward the slidable guide bracket in selective engagement with one of the plurality of apertures.

7. The refrigerator appliance of claim 4, wherein the stationary guide bracket includes a guide catch positioned at a top portion of the stationary guide bracket and a slide tab positioned at a bottom portion of the stationary guide bracket, and wherein a vertical slot is defined between the guide catch and the slide tab.

8. The refrigerator appliance of claim 1, further comprising:

a water conduit positioned on the stationary inner funnel between the passage axis and the slidable outer funnel.

9. The refrigerator appliance of claim 1, further comprising:

a variable actuator attached to the slidable outer funnel; and a controller operably coupled to the variable actuator to move the slidable outer funnel along the passage axis relative to the stationary inner funnel based on a received input.

10. The refrigerator appliance of claim 9, further comprising:

a proximity sensor operably coupled to the controller to detect a distance between the proximity sensor and a presented container, wherein the received input includes a signal received from the proximity sensor.

11. A refrigerator appliance comprising:

a cabinet defining a storage compartment;

an ice maker disposed within the storage compartment;

a door attached to the cabinet to selectively restrict access to the storage compartment, the door defining a dispenser recess in selective communication with the ice maker;

a dispenser conduit disposed on the door within the dispenser recess, the dispenser conduit including a stationary inner funnel and a slidable outer funnel extending along a passage axis, the stationary inner funnel having an internal surface and an external surface; the internal surface facing the passage axis and defining at least a portion of an ice passage, the external surface facing away from the passage axis, the slidable outer funnel being disposed over the external surface of the stationary inner funnel to selectively define an extended portion of the ice passage;

a stationary guide bracket fixed to the stationary inner funnel and extending radially outward therefrom; and a slidable guide bracket fixed to the slidable outer funnel and extending radially outward therefrom, wherein the stationary guide bracket includes a fixed track extending parallel the passage axis and defining an open channel facing the external surface of the stationary inner funnel, and wherein the slidable guide bracket includes a complementary track disposed within the open channel of the stationary guide bracket.

12. The refrigerator appliance of claim 11, further comprising:

a secondary outer funnel disposed over the slidable outer funnel to selectively define a secondary extended portion of the ice passage.

13. The refrigerator appliance of claim 12, wherein the slidable outer funnel defines a rear opening extending through the slidable outer funnel radially outward from the passage axis, wherein the secondary outer funnel defines a rear opening extending through the secondary outer funnel radially outward from the passage axis, and wherein the rear opening of the slidable outer funnel and the rear opening of the secondary outer funnel are aligned as an uninterrupted cross sectional area below a lower portion of the stationary inner funnel.

14. The refrigerator appliance of claim 11, wherein the slidable guide bracket defines a plurality of apertures indexed along the passage axis; and wherein the refrigerator appliance further comprises:

a stop pin attached to the stationary inner funnel and biased toward the slidable guide bracket in selective engagement with one of the plurality of apertures.

15. The refrigerator appliance of claim 11, wherein the stationary guide bracket includes a guide catch positioned at a top portion of the stationary guide bracket and a slide tab positioned at a bottom portion of the stationary guide bracket, and wherein a vertical slot is defined between the guide catch and the slide tab.

16. The refrigerator appliance of claim 11, further comprising:

a water conduit positioned on the stationary inner funnel between the passage axis and the slidable outer funnel.

17. The refrigerator appliance of claim 11, further comprising:

a variable actuator attached to the slidable outer funnel; and a controller operably coupled to the variable actuator to move the slidable outer funnel along the passage axis relative to the stationary inner funnel based on a received input.

18. The refrigerator appliance of claim 17, further comprising:

a proximity sensor operably coupled to the controller to detect a distance between the proximity sensor and a presented container, wherein the received input includes a signal received from the proximity sensor.

* * * * *